US006511402B2

(12) United States Patent
Shu et al.

(10) Patent No.: US 6,511,402 B2
(45) Date of Patent: Jan. 28, 2003

(54) POWER CONTROLLED EXERCISING MACHINE AND METHOD FOR CONTROLLING THE SAME

(75) Inventors: Stephen K. Shu, Fountain Valley, CA (US); Kirk A. Buhler, Corona, CA (US); James W. Pittaway, Anaheim, CA (US)

(73) Assignee: Unisen, Inc., Irvine, CA (US)

( * ) Notice: Subject to any disclaimer, the term of this patent is extended or adjusted under 35 U.S.C. 154(b) by 18 days.

(21) Appl. No.: 09/768,775

(22) Filed: Jan. 23, 2001

(65) Prior Publication Data

US 2001/0011052 A1 Aug. 2, 2001

Related U.S. Application Data

(62) Division of application No. 08/607,822, filed on Feb. 27, 1996, now Pat. No. 6,176,813, which is a division of application No. 08/249,248, filed on May 25, 1994, now Pat. No. 6,056,670.

(51) Int. Cl.[7] ..... A63B 21/00
(52) U.S. Cl. ..... 482/4; 482/900
(58) Field of Search ..... 482/1.9, 51, 52, 482/57, 63, 900–902

(56) References Cited

U.S. PATENT DOCUMENTS

| | | | |
|---|---|---|---|
| 219,439 | A | 9/1879 | Blend |
| 1,909,190 | A | 5/1933 | Sachs |
| 2,826,192 | A | 3/1958 | Mangas |
| 2,892,455 | A | 6/1959 | Hutton |
| 3,316,898 | A | 5/1967 | Brown |
| 3,475,021 | A | 10/1969 | Ruegsegger |
| 3,566,861 | A | 3/1971 | Weiss |
| 3,713,438 | A | 1/1973 | Knutsen |
| 3,756,595 | A | 9/1973 | Hague |
| 3,759,511 | A | 9/1973 | Zinkin et al. |
| 3,824,994 | A | 7/1974 | Soderberg, Sr. |
| 3,970,302 | A | 7/1976 | McFee |
| 4,053,173 | A | 10/1977 | Chase, Sr. |
| 4,185,622 | A | 1/1980 | Swenson |
| 4,188,030 | A | 2/1980 | Hooper |
| 4,298,893 | A | 11/1981 | Holmes |

(List continued on next page.)

OTHER PUBLICATIONS

TR 3900 Series SIMPLEMILL, 1997.
Elliptical Edge, 1998.
Commercial Products Catalog, 1997.

*Primary Examiner*—Glenn E. Richmon
(74) *Attorney, Agent, or Firm*—Knobbe, Martens, Olson & Bear, LLP

(57) ABSTRACT

An exercise machine is described which is entirely self-contained without any source of outside power. A rechargeable battery is used to maintain the exercise system operative for a time-out period. At all other times the machine is powered by the user. The machine is compact, light, rigid and sized to fit through a standard doorway. The entire exercise machine is provided with a wrap-around handrail into which a display input/output unit has been integrally provided. The exercise machine or stepper utilizes a dynamically controllable load or alternator which is controlled by a computer circuit to maintain the power input into the exercise machine or to maintain metabolically energy consumption rate within a user of the exercise machine at a predetermined, approximately constant level, regardless of the speed of stepping or the actual or effective weight of the user. The alternator is dynamically controlled by pulse width modulating its field coils. The power output by the generator is sensed by monitoring the alternator's output current and voltage. Additional load control is achieved by dissipating part of the alternator current in a dissipative load when the alternator voltage reaches a predetermined maximum set point.

11 Claims, 4 Drawing Sheets

U.S. PATENT DOCUMENTS 4,379,566 A 4/1983 Titcomb
4,456,276 A 6/1984 Bortolin
4,496,147 A 1/1985 DeCloux et al.
4,509,742 A 4/1985 Cones
4,555,109 A 11/1985 Hartmann
4,561,318 A 12/1985 Schirmacher
4,592,544 A 6/1986 Smith et al.
4,632,386 A 12/1986 Beech
4,645,200 A 2/1987 Hix
4,685,666 A 8/1987 DeCloux
4,687,195 A 8/1987 Potts
4,708,338 A 11/1987 Potts
4,709,918 A 12/1987 Grinblat
4,720,093 A 1/1988 Del Mar
4,733,858 A 3/1988 Lan
4,779,863 A 10/1988 Yang
4,786,050 A 11/1988 Geschwender
4,850,585 A 7/1989 Dalebout
4,869,494 A 9/1989 Lambert, Sr.
4,940,233 A 7/1990 Bull et al.
4,949,954 A 8/1990 Hix
4,949,993 A 8/1990 Stark et al.
4,951,942 A 8/1990 Walden
4,989,857 A 2/1991 Kuo
5,000,442 A 3/1991 Dalebout et al.
5,000,443 A 3/1991 Dalebout et al.
5,039,087 A 8/1991 Kuo
5,039,088 A 8/1991 Shifferaw
5,040,786 A 8/1991 Jou
5,048,821 A 9/1991 Kuo-Liang
5,062,627 A 11/1991 Bingham
5,067,710 A 11/1991 Watterson et al.
5,078,389 A 1/1992 Chen
5,131,895 A 7/1992 Rogers, Jr.
5,135,447 A 8/1992 Robards, Jr. et al.
5,139,469 A 8/1992 Hennessey et al.
5,163,888 A 11/1992 Stearn
5,186,697 A 2/1993 Rennex
5,195,935 A 3/1993 Fencel
5,238,462 A 8/1993 Cinke et al.
5,242,343 A 9/1993 Miller
5,243,412 A 9/1993 Chen
5,279,529 A 1/1994 Eschenbach
5,290,211 A 3/1994 Stearn
5,295,928 A 3/1994 Rennex
5,299,993 A 4/1994 Habing
5,320,588 A 6/1994 Wanzer et al.
5,352,169 A 10/1994 Eschenbach
D355,006 S 1/1995 Lo
5,383,829 A 1/1995 Miller
5,401,226 A 3/1995 Stearn
5,403,252 A 4/1995 Leon et al.
5,403,255 A 4/1995 Johnston
5,419,747 A 5/1995 Piaget et al.
5,423,729 A 6/1995 Eschenbach
5,496,235 A 3/1996 Stevens
5,499,956 A * 3/1996 Habing et al. ..... 482/52
5,518,473 A 5/1996 Miller
5,527,246 A 6/1996 Rodgers, Jr.
5,529,554 A 6/1996 Eschenbach
5,529,555 A 6/1996 Rodgers, Jr.
5,540,637 A 7/1996 Rodgers, Jr.
5,549,526 A 8/1996 Rodgers, Jr.
5,562,574 A 10/1996 Miller
5,573,480 A 11/1996 Rodgers, Jr.
5,577,985 A 11/1996 Miller
5,591,107 A 1/1997 Rodgers, Jr.
5,593,371 A 1/1997 Rodgers, Jr.
5,593,372 A 1/1997 Rodgers, Jr.
5,595,553 A 1/1997 Rodgers, Jr.
5,611,756 A 3/1997 Miller
5,611,757 A 3/1997 Rodgers, Jr.
5,611,758 A 3/1997 Rodgers, Jr.
5,616,106 A 4/1997 Abelbeck
5,637,058 A 6/1997 Rodgers, Jr.
5,653,662 A 8/1997 Rodgers, Jr.
5,658,227 A 8/1997 Stearn
5,685,804 A 11/1997 Whan-Tong et al.
5,690,589 A 11/1997 Rodgers, Jr.
5,692,994 A 12/1997 Eschenbach
5,707,321 A 1/1998 Maresh
D393,027 S 3/1998 Chen
5,733,227 A 3/1998 Lee
5,735,774 A 4/1998 Maresh
5,738,614 A 4/1998 Rodgers, Jr.
5,741,205 A 4/1998 Doll et al.
5,746,683 A 5/1998 Lee
5,755,642 A 5/1998 Miller
5,755,643 A 5/1998 Sands et al.
5,759,135 A 6/1998 Chen
5,759,136 A 6/1998 Chen
5,762,588 A 6/1998 Chen
5,766,113 A 6/1998 Rodgers, Jr.
5,769,760 A 6/1998 Lin et al.
5,772,558 A 6/1998 Rodgers, Jr.
5,779,598 A 7/1998 Lee
5,779,599 A 7/1998 Chen
5,782,722 A 7/1998 Sands et al.
5,788,609 A 8/1998 Miller
5,788,610 A 8/1998 Eschenbach
5,792,026 A 8/1998 Maresh et al.
5,792,029 A 8/1998 Gordon
5,800,315 A 9/1998 Yu et al.
5,803,871 A 9/1998 Stearn et al.
5,803,872 A 9/1998 Chang
5,813,949 A 9/1998 Rodgers, Jr.
5,820,524 A * 10/1998 Chen ..... 482/51
5,836,854 A * 11/1998 Kuo ..... 482/52
6,063,009 A 5/2000 Stearn et al.

* cited by examiner

POWER CONTROLLED EXERCISING MACHINE AND METHOD FOR CONTROLLING THE SAME

RELATED APPLICATIONS

This application is a division of U.S. patent application Ser. No. 08/607,822, filed on Feb. 27, 1996, now issued as U.S. Pat. No. 6,176,813, which was a division of U.S. patent application Ser. No. 08/249,248, filed on May 25, 1994, now U.S. Pat. No. 6,056,670.

BACKGROUND OF THE INVENTION

1. Field of the Invention

The invention relates to the field of exercising machines, and in particular to exercising machines simulating a stepping or climbing action in which the rate of energy input into the exercise machine, or more generally the power output of the human exerciser, is monitored and the load of the exercising machine controlled to maintain power input into the machine or power output from the human exerciser more accurately monitored.

2. Description of the Prior Art

Stepping exercise machines are well known to the art and have been built with a large number of designs and control methodologies. Typical examples of prior art stair climbing or stepping exercise machines can be found in Robards, Jr. et al, "Exercise Apparatus for Simulating Stair Climbing," U.S. Pat. No. 5,135,447 (1992); Hennessey et al., "Exercise Machine and Transmission Therefor," U.S. Pat. No. 5,139,469 (1992); Bull, "Exercise Apparatus," U.S. Pat. No. 5,013,031 (1991); Stark et al., "Exercise Apparatus Having High Durability Mechanism for User Energy Transmission," U.S. Pat. No. 4,949,993 (1990); and Potts, "Stair Climbing Exercise Apparatus," U.S. Pat. No. 4,708,338 (1987). The type of mechanical linkages and arrangements to provide the stair climbing action, the types of load devices as well as how those loads are controlled varies considerably over the art and different examples can be found in each of these references.

For example, in Sweeney, Jr., "Program Exerciser Apparatus and Method, " U.S. Pat. No. 4,358,105 (1982), a stepper is described which uses a pony brake as a load in combination with a flywheel in which the speed of the flywheel is controlled by a computer. In such devices, the energy rate or power of the exerciser, or at least the power input into the exercise machine by the human exerciser, varies considerably, not only over the course of a given exercise session, but dramatically between one exerciser and the next for the same speed control setting.

Such stepper machines usually include various handrails to allow the exerciser to steady himself or herself on the machine while exercising. It is almost a universal characteristic that exercisers will tend to lean on or support themselves in part on these handrails to effectively lighten or offset their weight on the stepping pedals and hence to decrease the amount of work that they put into the machine at a given speed setting.

Furthermore, the amount of energy expended by a petite 98-pound girl operating at a given speed, for example 20 steps per minute, is substantially different than the same amount of energy input into the machine by a 285-pound male line-backer also exercising at the rate of 20 steps per minute.

In addition, it must be kept in mind that in terms of health and exercise physiology, the important parameter is not the energy which is input into the machine, but rather the energy which the human user actually expends during the exercise. Only a small fraction of the energy burned in the human body ends up in measurable energy input into the exercise machine. By far, the greater amount of energy or calories burned is lost to sweat, body heat radiation and respiration.

Therefore, what is need is some type of a stepping or exercising machine and method for controlling the exercising machine whereby true, quantitative values of power input into the machine can be monitored and the machine load controlled to maintain those power levels substantially constant, and also to control the machine load relative to actual body power consumption during exercise.

BRIEF SUMMARY OF THE INVENTION

The invention is an exercise machine for providing power controlled exercise for a user comprising an exercise input unit to transform human exercise into a predetermined motive force. A dynamically controllable load is driven by the predetermined motive force. A sensing circuit senses the power coupled into the load through the exercise input unit. A control circuit controls the dynamically controllable load to require a user-selected amount of power to be provided to the exercise input unit by the user. As a result, the exercise machine operates to provide a substantially constant and quantifiable energy rate of exercise.

The exercise machine further comprises a base chassis in which the exercise input unit is disposed. A wrap-around hand railing coupled to the base chassis completely encircles the user except at an entry position. An input/output display module is coupled to the control circuit and is integrally formed with the wrap-around hand railing. The base chassis, wrap-around hand railing, and display module have an overall geometric envelope characterized by a width. The width has a dimension less than a standard residential door width to facilitate ease of movement of the exercise machine.

The circuit for controlling the load controls the load to maintain power input by the user into the exercise input unit at a predetermined approximate power level, or to maintain metabolic power of the user at a predetermined level when the user is inputting power into the exercise input unit.

In the illustrated embodiment the exercise input unit is a stepper, and the dynamically controllable load is an alternator. The alternator has field coils, and the circuit for controlling the load comprises a field control circuit for pulse width modulating the field coils of the alternator.

The dynamically controllable load more generally comprises a circuit for generating electrical power and a variable dissipative electrical load coupled to the circuit for generating electrical power.

The dynamically controllable load generates a sensible electrical output and the circuit for sensing power coupled into the load comprises a computer having an input coupled to the sensible output of the dynamically controllable load. The computer generates an output coupled to the dynamically controllable load to maintain the load at a predetermined level of power input.

The exercise machine further comprises a tachometer for sensing rate of mechanical power input into the exercise input unit. The tachometer is coupled to the control circuit so that the control circuit controls the load in response to the tachometer and to the sensing circuit. The sensing circuit'senses time dependent output voltage and output current generated by the alternator.

The dynamically controllable load generates electrical power and is the sole source of electrical power for the sensing circuit and control circuit. The exercise machine further comprises a battery circuit to provide startup field coil power to the alternator prior to the alternator having reached a predetermined output level. The battery circuit further powers the sensing circuit and control circuit for a predetermined time-out period after the alternator ceases to generate electrical power. The control circuit also disconnects the battery circuit from the sensing circuit and control circuit after elapsed of the predetermined time-out period.

The controllable load provides electrical charging power to the battery circuit to recharge the battery circuit so that the exercise machine is entirely self-powered by the user.

The invention is also characterized as a method for controlling an exercise machine comprising the steps of transforming motion of a user into a predetermined mechanical motive force, and dynamically resisting the predetermined motive force to maintain an approximately constant power input into the exercise machine. As a result, quantifiably controlled energy rate levels of exercise are achieved.

The step of transforming user motion into the predetermined motive force comprises the step of converting stepping motion into motion of a shaft, and generating electrical power from rotation of the shaft at a predetermined magnitude. In the illustrated embodiment the step of generating electrical power at a predetermined magnitude comprises the step of generating electrical power in an alternator having current in its field coils pulse width modulated in response to sensed current and voltage output from the alternator to maintain the predetermined magnitude of power.

The method may further comprise the step of selectively shunting a portion of current from the alternator into a dissipative load to further control the step of dynamically resisting the motive force.

The invention can also be characterized as an improvement in an exercise machine for providing exercise for a user. The exercise machine has an electrically OFF and an electrically ON operational status and comprises an input unit to transform human exercise into a motive force. A load, which in the preferred embodiment is electromechanical, is driven by the motive force. An input/output circuit provides a readout to the user. The improvement comprises a power-up circuit for providing electrical power to the input/output circuit upon initiation of normal use of the exercise machine so that operational status of the exercise machine is changed from the electrically OFF status to the electrically ON status without the assistance of any external source of electrical power.

The invention is also an improvement in a stepper having a pedal pivotally coupled to a four-bar linkage where the four linkage is coupled to a frame and the frame disposed on a supporting floor. The four-bar linkage comprises an upper arm pivotally coupled to the pedal at a first pivot point and to the frame at a second pivot point. A pedal arm is pivotally coupled to the pedal at a third pivot point spaced from the first pivot point and to the frame at a fourth pivot point spaced from the second pivot point. The spacing between the first and third pivot points and between the second and fourth pivot points is arranged so that an imaginary line extending between the first and second pivot points of the upper arm is nonparallel to an imaginary line extending between the third and fourth pivot points. The pedal is oriented at least in one position of the four-bar linkage nonparallel to the floor.

The pedal defines an angle of orientation with respect to the floor, and is capable of assuming an up position and a down position. The four-bar linkage varies the angle of orientation of the pedal as the pedal is moved between the down position and the up position.

The invention is still further a method of providing a varied exercise session in a variably loaded exercise machine comprising the steps of providing a prestored sequence of loading conditions for the exercise machine and entering the prestored sequence of loading conditions at an arbitrary entry point within the sequence. The exercise machine is loaded according to the prestored sequence starting with the arbitrarily entered entry point and following the loading conditions in the prestored sequence.

The prestored sequence of loading conditions has a first loading condition and a last loading condition in the sequence and further comprises the step of loading the exercise machine with the first loading condition and contingently subsequent ones of the prestored sequence after the exercise machine has been loaded by the last loading condition.

The method further comprises the steps of detecting a machine startup event indicative of an operational state of the exercise machine and detecting a user selected time for the entry point. A time lapse between detection of the machine startup event and the user selected time is determined in order to select a beginning one of the loading conditions in the prestored sequence of loading conditions as an initial loading condition imposed on the exercise machine. The sequence of loading conditions are a multiple of a predetermined number and wherein the entry point is determined by taking the elapsed time modulo the predetermined number to give a remainder which identifies the initial loading condition.

The invention may be better visualized by now turning to the following drawings wherein like elements are referenced by like numerals.

The invention and its various embodiments may now be understood by turning to the following detailed description.

DETAILED DESCRIPTION OF THE PREFERRED EMBODIMENTS

An exercise machine is described which is entirely self-contained without any source of outside power. A rechargeable battery is used to maintain the exercise system operative for a time-out period. At all other times the machine is powered by the user. The machine is compact, light, rigid and sized to fit through a standard doorway. The entire exercise machine is provided with a wrap-around handrail into which a display input/output unit has been integrally provided. The exercise machine or stepper utilizes a dynamically controllable load or alternator which is controlled by a computer circuit to maintain the power input into the exercise machine or to maintain metabolically energy consumption rate within a user of the exercise machine at a predetermined, approximately constant level, regardless of the speed of stepping or the actual or effective weight of the user. The alternator is dynamically controlled by pulse width modulating its field coils. The power output by the generator is sensed by monitoring the alternator's output current and voltage. Additional load control is achieved by dissipating part of the alternator current in a dissipative load when the alternator voltage reaches a predetermined maximum set point.

Figure 1:
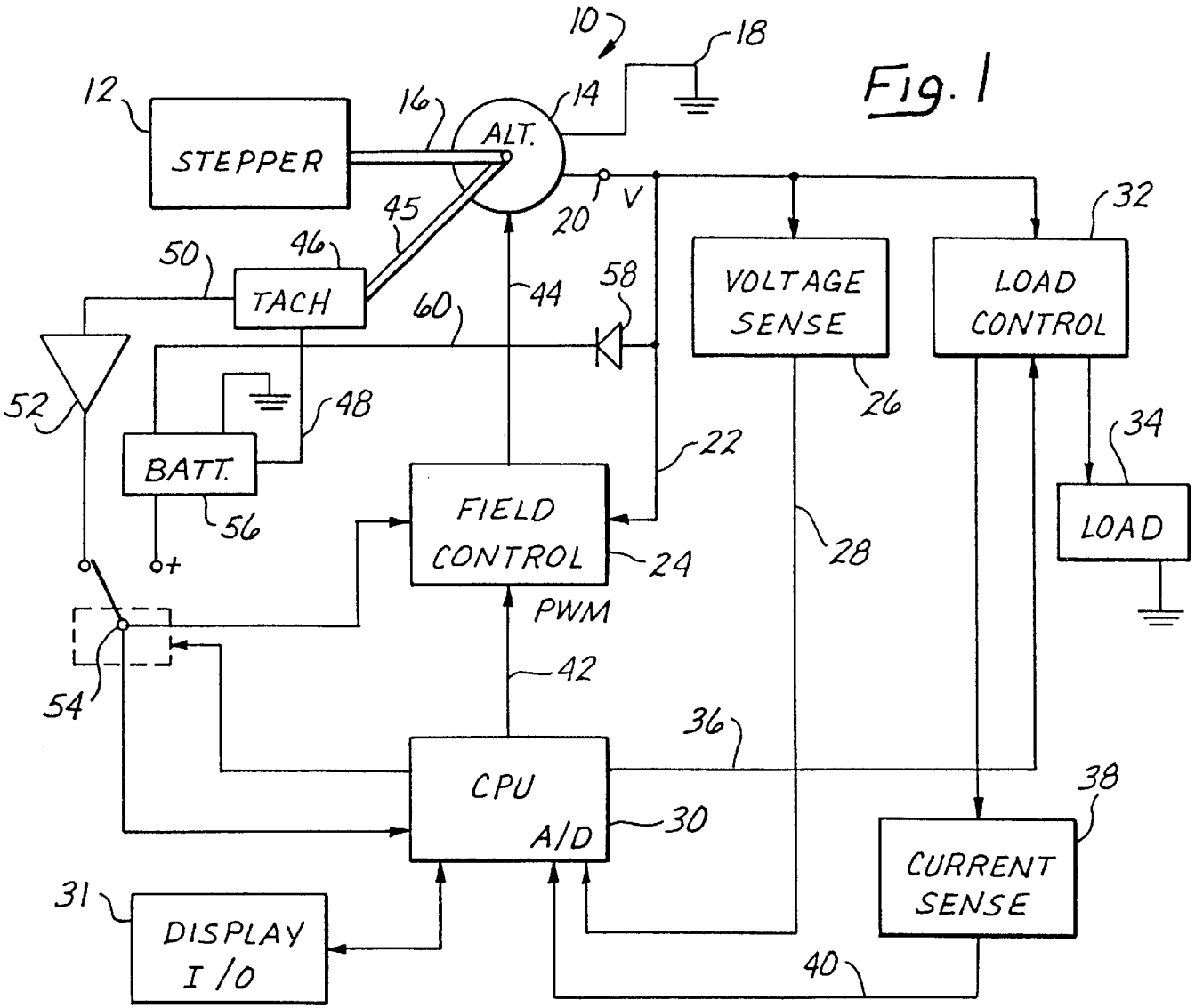
FIG. 1 is a simplified block diagram of a stepper and circuit used to control a dynamic load on the stepper.

FIG. 1 is a simplified block diagram of a system, generally denoted by reference numeral 10, for a power controlled exercising machine or stepper. One example of a stepper or climbing machine in which the system of FIG. 1 is utilized is shown in perspective view in FIG. 4.

Figure 4:
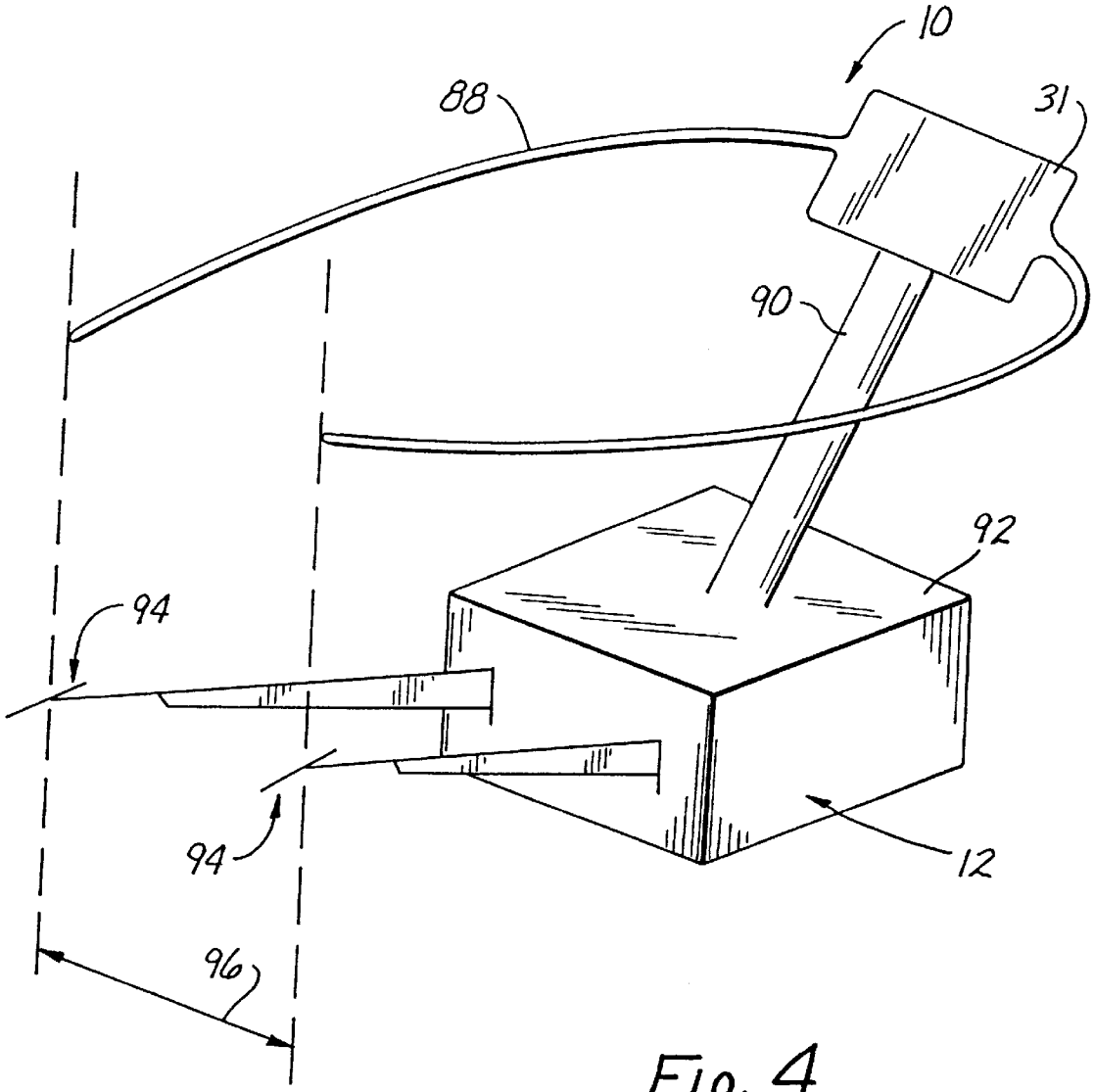
FIG. 4 is a perspective view of the machine operated according to the teachings of FIGS. 1–3 for which an improved wrap around handrail is provided.

The system of FIG. 1 is shown in one embodiment in the exercise machine shown in FIG. 4. Exercise stepper 10 of FIG. 4 includes a wrap-around support rail 88 connected by means of stanchion 90 to a base 92. Coupled on support rail 88 is a terminal and display, or input/output unit 31.

Base 92 includes mechanical stepper 12 and in particular a pair of independently operated pedal assemblies 94. No exterior power connection is provided or required with system 10. Display 31 is integrally formed with wrap-around rail 88, which provides a construction which is more rugged, more reliable and less prone to damage or misadjustment.

The maximum width 96 of stepper 10 is particularly chosen to be slightly below the standard residential doorway width. Thus, system 10, which may be provided with collapsible rollers beneath base 92 (not shown), can be easily moved through the residential doorway without struggle or the need to disassemble system 10.

The mechanical portion of the stepper system, generally denoted by reference numeral 10 is diagrammatically depicted in FIG. 1 as a mechanical stepper unit 12. It must be understood that in the context of the present invention, stepper 12 is to be construed as any type of exercise equipment or device whereby a human exerciser may translate exercise of any one of the limbs or portion of the body into a motion which is translated into a motive force capable of driving a load. Thus stepper 12 is meant to include rowing machines, treadmills, climbing machines, skiing machines, skating machines and any type of exercise or work load machine now known or later devised.

In the illustrated embodiment, the load is a dynamic load diagrammatically illustrated in FIG. 1 as an alternator 14. Any type of load may be utilized in connection with system 10 of FIG. 1 and with the methodology of FIG. 2 consistent with the spirit of the scope of the teachings of the invention. Therefore, generators, friction brakes, pony brakes, air brakes, dynamometers, and any other type of dynamic or controllable load device now known or later devised can be used in place of alternator 14.

In any case, alternator 14 is mechanically coupled to stepper 12 by a drive or transmission diagrammatically depicted in FIG. 1 as line 16. The actual connection may be a shaft, chain, transmission, belt or any means for transmitting or transforming motion. The electrical output of alternator 14 is shown as a ground terminal 18 and a power terminal 20 having an output voltage V.

Exerciser system 10 of the present invention is self-contained. That is, it provides substantially all of its own electrical power for operation through the exerciser's input. Battery assisted startup is provided as described below. However, the principal energy source for the circuitry for controlling system 10 is the power input by the exerciser him or herself. This output power voltage is provided on line 22 to field control circuit 24. The voltage is also provide to a voltage sense circuit 26 which has an analog output on line 28 coupled to the analog to digital converter inputs of a central processing unit (CPU) 30. By this means, a digital representation of the voltage output by alternator 14 is available within CPU 30 for processing a dynamic control command.

Output voltage V on node 20 is also supplied to a load control circuit 32. Load control circuit has coupled to it a conventional resistive electrical load 34. Load control circuit 32 selectively provides a varying degree of current to resistive load 34 according to control received by load control circuit 32 on line 36 from CPU 30.

The current being delivered to load 34 is sensed by current sense circuit 38 which is coupled to load control circuit 32, or if desired, may obtain its sensing pickup from load 34. The sensed, current input to circuit 38 is then provided on line 40 to the analog to digital converter input of CPU 30. Thus, CPU 30 has both the current being output by alternator 14 and the voltage from alternator 14 available as digital inputs for generating a dynamic control command. The product of these two variables is the electrical power which is being consumed within system 10.

CPU 30 develops a control or command signal which is applied on control line 42 to field control circuit 24. Field control circuit 24 in turn provides as its output on line 44 the field coils of alternator 14. In the illustrated embodiment, the command signal on line 42 is a command signal, which is used to pulse width modulate the field coil current in alternator 14.

Mechanically coupled to alternator 14 by a conventional mechanical means 45 is a tachometer 46, which has electrical outputs indicative of the speed at which alternator is being turned. One such output is provided on line 48 as an input to switch 54 to switch battery power to CPU 30 and field control 24. Another output is provided on line 50 to an amplifier 52 and feeds to CPU 30 once the CPU is "on". CPU 30 holds switch 54 "on" even after the alternator stops operating and keeps the power on for 30 seconds. Thus, depending on speed of alternator 14, system 10 can during startup and thereafter during an operation have the electrical power requirements of the control circuitry of system 10 powered either by means of battery circuit 56 or by alternator 14. When alternator 14 is being driven by the exerciser at a sufficient speed to provide the proper voltage for system 10, part of the output power is also drained through a charging diode 58 to a voltage regulator (not shown) and provided on line 60 to recharge the battery within battery circuit 56. The unamplified tachometer output is provided on line 48 to battery circuit 56. The voltage is generated within the tachometer itself by virtue of its mechanical drive from alternator 14. The voltage is, however, too low to power the logic circuitry within system 10. Nonetheless, switching circuit 54, which normally leaves battery 56 disconnected from system 10 system so that it does not discharge, will connect the battery to system 10 after a predetermined voltage level is developed by tachometer 46 on line 48.

The battery circuit then is connected through switch 54 to field control circuit 24 which enters a startup routine to flash the field coils on alternator 14 to bring the output voltage of alternator 14 up to the 5-volt logic level required to power the remaining elements within the circuitry of system 10, including CPU 30. Once alternator 14 is up to the operating voltage level, amplifier 52 is powered and the output of tachometer 46 is amplified and switched back through switch 54 and is available on a usable TTL signal level required by CPU 30.

One of the features of system 10 as shown in FIG. 1 is that battery circuit 56 is switched into the system as the power source by switch 54 for a predetermined period of time after which tachometer 46 indicates that alternator 14 is no longer being turned. The time out period is variable and in the illustrated embodiment, it may be preset at 30 seconds. This allows the user to step off the machine, attend to another matter for a short period, and then return without loss of the input or control data within CPU 30 and display 31. For example, the user may set the machine at 100 calorie per rate metabolic output for a 30-minute exercise period. After 18 minutes, the user may for some reason decide to step off the machine for a short period. Thereafter, the user may return to the machine and resume the exercise session without any loss of the input power rating or exercise level desired or loss of recordation of the elapsed time of the exercise session completed up to that point. Power usage within the control circuitry of the system of FIG. 10 is relatively minor and can be easily sustained for considerable periods by battery circuit 56 without unduly discharging the battery during normal exercise usages.

The general mechanical elements and electrical elements of system 10 now having been described in connection with FIG. 1, turn to FIG. 2 wherein the methodology of operation of the circuitry of FIG. 1 is diagrammatically described. CPU 30 includes both RAM and ROM program memory for operating the control algorithm shown in FIG. 2. Digital representations of the current, I, and voltage, V, output by alternator 14 are combined in CPU 32 in a product which is representative of the electrical power being resistively dissipated or consumed within system 10. The digital signals are time dependent and thus power phase can be included in the power computation. The output of software module 62 can then be conceptionally thought of as the algebraic product, $K_1IV$, where $K_1$ is a scaling factor.

In addition to the electrical power being consumed by system 10, a certain amount of mechanical power is also being input into the mechanical elements of stepper system 10. For example, stepper 12 as shown in FIG. 4 has a pair of independently operated pedals upon which the exerciser stands and pumps. Each of these pedals is spring loaded so that a certain amount of force is required to lower the pedal against the return spring force. When the exerciser lifts his foot, the spring contracts and raises the pedal to its return position. In addition, there is a predetermined amount of friction and air resistance in the entire stepper mechanism 12. Both the distributed frictional load in stepper 12 as well as the amount of energy put in to the spring return extensions of the pedals has a mechanical power input which is proportional to how fast the exerciser steps, which in turn is related to the speed at which alternator 14 turns. Thus, tachometer 46 provides an alternator speed signal depicted in FIG. 2 as an input to software module 64 wherein it is multiplied by an appropriate scaling factor $K_2$ to produce a product $K_2S$ which is equal to the mechanical power input into system 10. The scaling factors, $K_1$ and $K_2$, can be theoretically estimated and/or empirically determined. Thus, the total power being input into system 10 is the sum of the mechanical power in the electrical power being consumed or $P_{input}=P_{mech}+P_{elec}$.

The human user inputs into the input/output circuit 31 a desired power level which may be quantitatively calibrated in terms of calories per hour, calories per minute, watts, horsepower or Joules per minute. In any case, the user presets a number, N, which is a the goal number indicating the power at which the user wishes to maintain his input into system 10. The set N is then used in software module 66 to generate a command or power set level, $P_{set}$. The computed power levels $P_{mech}$ and $P_{elec}$ are then summed and compared to the set power level $P_{set}$ in a comparator software module 68. The difference between $P_{set}$ and the sum of $P_{mech}$ and $P_{elec}$ is an error signal indicating the margin by which the user's actual power output exceeds or lags the power level which is desired. This error signal, E, is then input into a software module 70 which develops a command signal according to the specific requirements and nature of system 10. The command signal is then used to create a pulse width modulated field command signal in software module 72. The pulse width modulated command signal is then provided on control line 42 from CPU 32 to field control circuit 24 to dynamically set the mechanical load provided by alternator 14 by pulse width modulation of the field coil currents in alternator 14. A load control command is also provided by CPU 30 on line 36 to load control circuit 32.

The power output by alternator 14 is principally controlled by the pulse width modulation of the current in the field coils of alternator 14, which is controlled by the command signal on line 44 from field control circuit 24. However, until the output voltage on node 20 of alternator 14 has reached a predetermined level, for example 10 volts, load control 32 is controlled by CPU 30 to shunt none of the current into load 34. Instead, the required load is provided by appropriate pulse width modulation of the field coil current in alternator 14.

After the output voltage on alternator 14 has reached the predetermined level, again 10 volts for example, it may no longer be desirable to continue to increase the voltage output from alternator 14 as more mechanical power is input. Additional load is provided by selectively shunting portions of the output current into dissipative load 34. The voltage output of alternator 14, thus, remains stabilized at the predetermined voltage and as increasing amounts of mechanical power are input into alternator 14, the additional energy is dissipated by means of increased current shunting through load control circuit 32 into load 34 under the command of CPU 30 through the error signal developed on command line 36.

Figure 3:
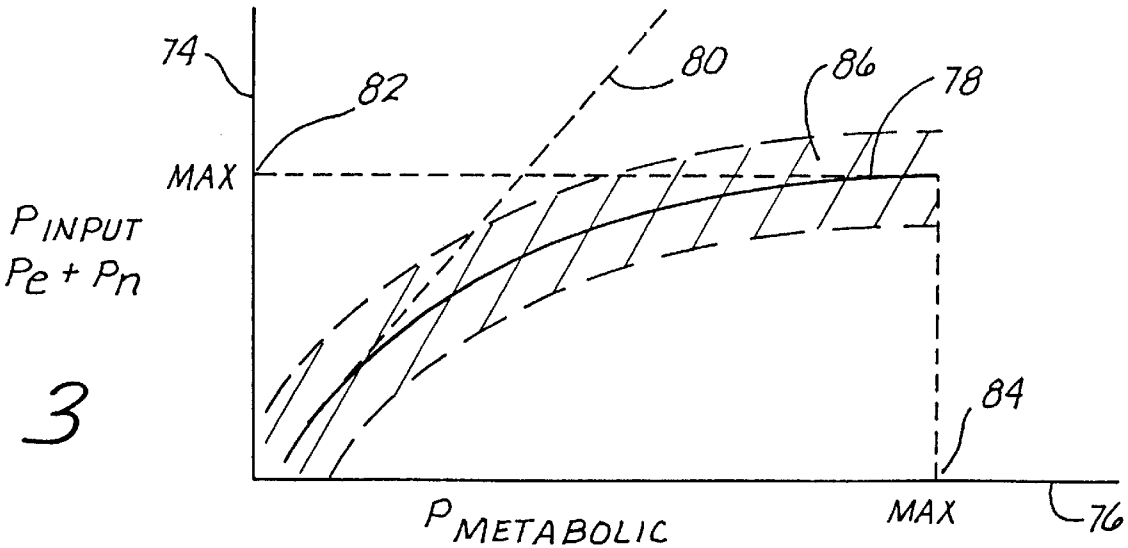
FIG. 3 is a simplified graph illustrating the relationship between power consumed in the human body to power input into an exercising machine or task.

Turn now to FIG. 3 which illustrates the conceptional relationship between power input into system 10 which is the sum of the electrical power absorbed within system 10 and the mechanical power absorbed within system 10 and the metabolic energy usage rate in the human exerciser. The vertical scale 74 of the graph of FIG. 3 is the power input into system 10, while the horizontal axis 76 represents the metabolic power actually being consumed in the human user in both motive force. and total muscle energy consumption rates, which be manifested in energy losses through respiration, sweat and radiant heat. It is established through metabolic studies that the human machine has a nonlinear efficiency. In other words, as the actual motive work rate output of the human machine increases, the total rate of metabolic energy usage increases more rapidly so that power output as a function of metabolic power falls off as generally indicated by curve 78 from a linear relationship indicated by line 80.

At the high end of energy output, the human body becomes increasingly inefficient in converting metabolic power into motive power output. Both motive power output and metabolic power consumption are limited at different maximum points 80 and 82 respectively in each individual. The maximal points 80 and 82 as well as the exact quantitative nature of curve 78 achievable by any given individual will vary from individual, and even with a single individual over the course of time due to many different physiological and psychological factors. However, the curves for all individuals can be determined to fall within a certain statistical domain indicated by shaded region 86 in FIG. 3. Although the maximal points 82 and 84 may vary dramatically as between individuals, the majority of performance curves 78 can as a practical matter be confidently assumed to be within region 86.

From the power input levels in system 10 and their functional relationship to total metabolic power of the user as empirically determined, a graph or look-up table of the nature of FIG. 3 can be constructed and stored within the memory of CPU 30.

Therefore, in an alternative embodiment of the invention, the sum of the mechanical electrical power developed by the exerciser from modules 62 and 64 can be summed in a module 88 and then an average total metabolic power rate derived from a look up table based on data as depicted in FIG. 3 for use in software module 68 to produce the error signal, E.

Figure 2:
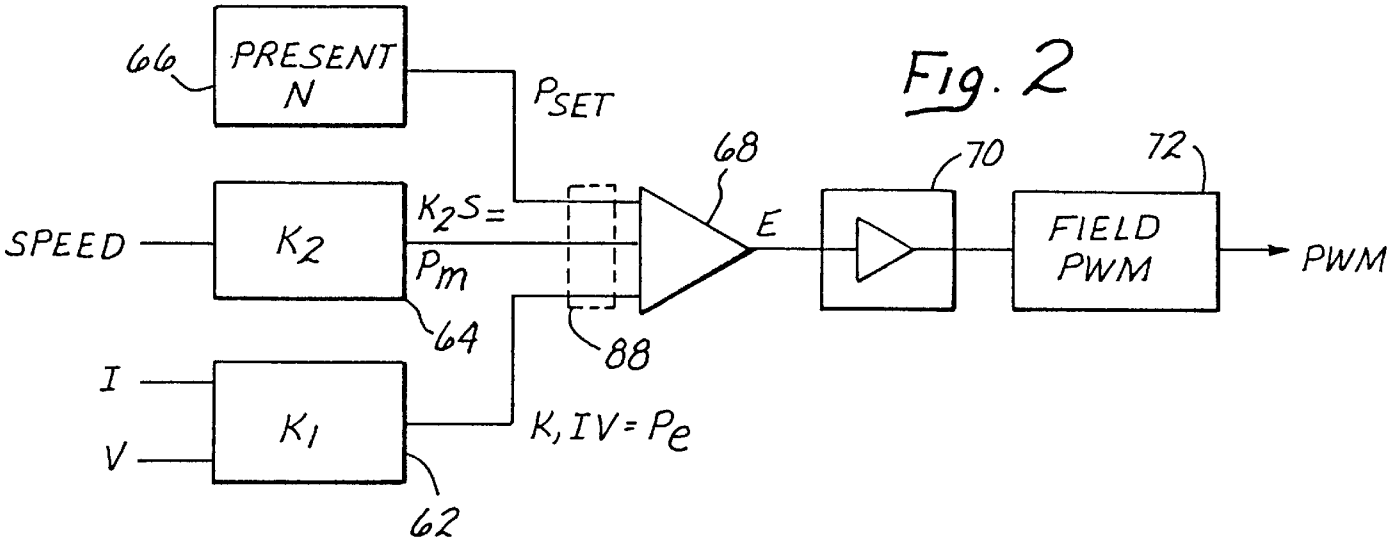
FIG. 2 is a block diagram illustrating the methodology whereby the circuit of FIG. 1 is controlled to provide a constant power input into the stepper.

In this way, the user then inputs an energy rate into I/O unit 31, which is then translated into software module 66 of FIG. 2 which represents, not the power to be maintained by the exercise level in stepping system 10, but instead the power which the human machine itself, the metabolic rate of the human exerciser, totally consumes in order to maintain the selected exercise level.

Consider then how the invention differs from typical prior art, speed-controlled steppers. When the user steps onto the machine and sets a given metabolic or machine input power level, the machine is powered up as the tachometer indicates that the alternator is being turned, the alternator field coils are flashed on, and the alternator voltage rises as the control logic within system 10, referred to as the upper board circuitry, powers up and comes on line. Within a very few seconds, the voltage on alternator 14 is at 5 volts or above thereby fully powering the upper board circuitry. The field coils on alternator 14 are then pulse width modulated to provide the appropriate load to the user. If this load can be provided at a voltage output of alternator 14 below 10 volts, no substantial amount of current is dissipated in load 34.

If the user should slow down his stepping rate for any reason, alternator 14 is then controlled to provide a greater load so that the amount of power which the user must input into the machine remains approximately constant. If the user for any purpose should lean on the support railings provided with system 10 as shown in FIG. 4, the force on the pedals to the other user's feet will decrease, and again the circuitry of the invention will modulate the field windings of alternator 10 to increase the load so that approximately the same amount of power is input into the machine or output from the exerciser.

In the same way, if the level of exercise is sufficiently high to drive the voltage of alternator 14 above a predetermined level, then the excess power will be dumped into a dissipative resistive load 34 through appropriate control of load control circuit 32 in the same manner as is implemented with respect to slowing or increasing of speed of stepping of the user or different distributions of the user's weight.

Similarly, if the petite 98-pound girl steps off the stepper and the 285-pound full-back steps on at the same power input setting, the heavier user will be able to maintain the power setting input by the lighter user at a lower stepping rate, because the circuitry of system 10 will immediately sense the increased torque applied to alternator 14 through stepper 12. The resistance or load provided by alternator 14 and/or shunted to dissipative load 34 will be adjusted to keep the input power or metabolic power of the user approximately constant.

The stepper may be operated to comprise a deliberate insertion of a seed number by the user. The seed number is determined by the total elapsed time which has passed in the exercise between initiation and when a variable mode is entered by manual push button by the user into I/O device 31 in FIG. 1. Initiation can be defined as any start-up event, such as the time at which the output of alternator 14 achieves a predetermined output voltage level or tachometer 46 a predetermined speed output. Elapsed time inseconds is divided modulo 240 (4 minutes) to obtain a remainder. The remainder in seconds is then a memory location between 0 and 239 in which a load value is prestored. CPU 30 should be understood as including on-chip or associated read-only memory as well as random access memory used for normal processing functions.

The next 20 consecutive memory locations are then read at one minute intervals to establish load instructions from CPU 30 to provide a varied 20 minute workout. Memory read wraps around from location 239 to 0 in a cyclic manner so that in the space of a 20 minute workout the load sequence wraps around or repeats five times or once every four minutes. The sequence of load values in the memory locations are prestored and predetermined and cannot be varied by the user.

The user can deliberately select a repeatable exercise sequence by always entering the sequence at the same time or times modulo 240. There is no randomness or pseudo-randomness in the manner in which the exercise sequences are provided, beyond any human randomness or pseudo-randomness, if any, chosen by the user as the start point of the varied prestored sequence. If there is any randomness it is a function of human behavior and not that of the apparatus. Thus the user has the option of entering the load sequence at any point which allows the user to have a varied, but predictable exercise session.

Figure 5:
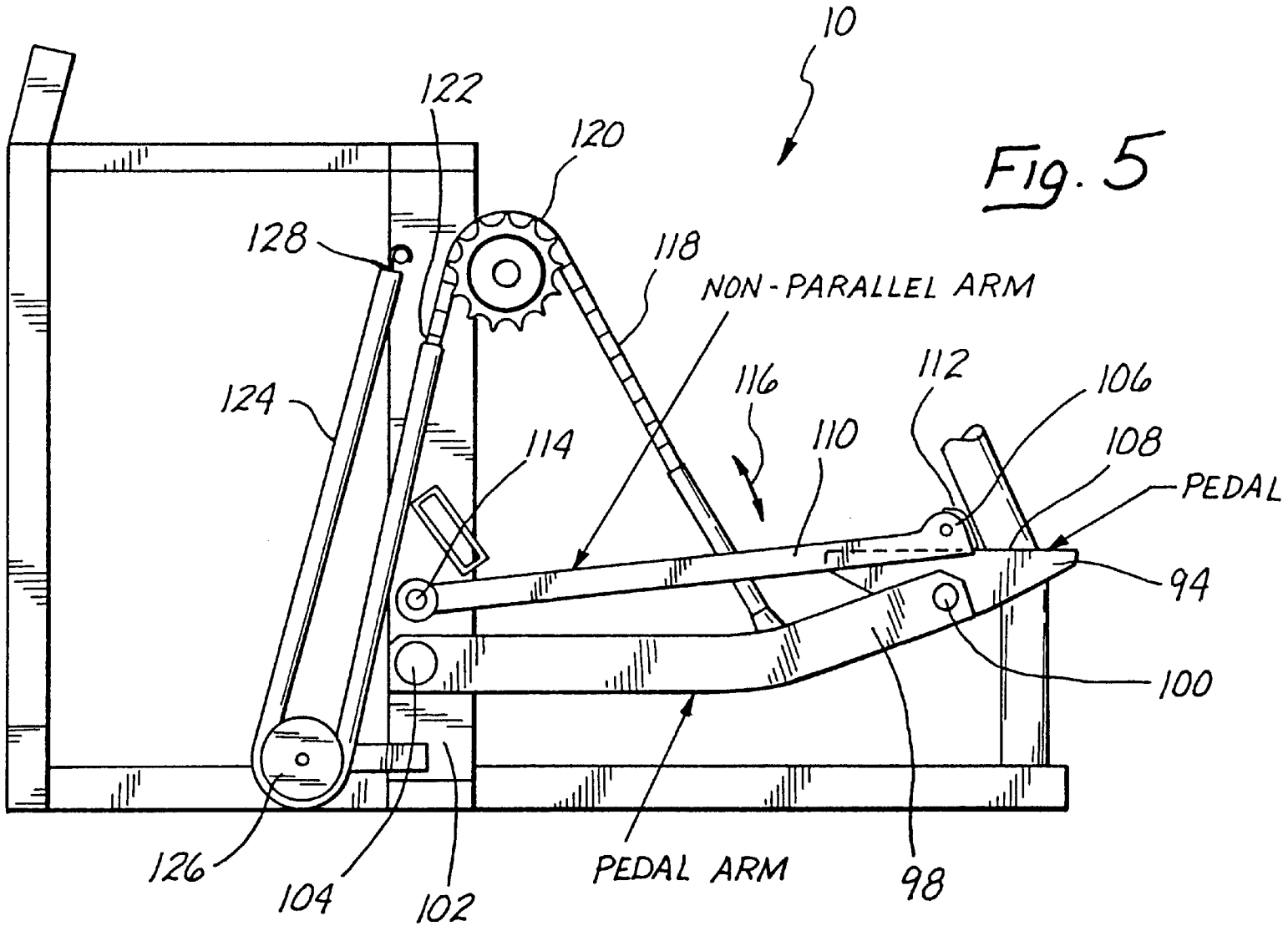
FIG. 5 is a simplified side elevational view of a four-bar linkage which may be used according to the invention to vary the angle of orientation of the foot pedal of the stepper.

FIG. 5 is a simplified side elevational view of one embodiment exercise system 10 illustrating the linkages between pedal 94 and other elements of the system. Pedal 94 is coupled to a pedal arm 98 about a pivot pin 100. The opposing end of arm 98, in turn, is pivoted to a frame 102 about a pivot pin 104. A flange 106, extending vertically above pedal surface 108 from the side of pedal 94, is pivotally coupled to an upper arm 110 about a pivot pin 112. Opposing end of upper arm 110, in turn, is pivotally coupled to frame 102 about a pivot pin 114.

Thus, pedal 94 is supported by a four-bar linkage comprised of frame 102, pedal arm 98, pedal 94 and upper arm 110. However, unlike many other four-bar linkages used in exercise machines and systems, the four-bar linkage shown in FIG. 5 is comprised of two non-parallel arms. An imaginary line between pivot pins 104 and 100 coupled to arm 98 is nonparallel to a similarly constructed imaginary line between pivots 114 and 112 of arm 110. The result of two nonparallel opposing arms in a four-bar linkage means that the treadle surface 108 of pedal 94 changes its inclination as the four-bar linkage rotates upwardly and downwardly as symbolically denoted by arrow 116. The inclined pedal provides for a more gentle or rocking support for the exerciser's feet to reduce the amount of ankle flexure required from the exerciser between the position when the pedal is closest to the floor and compared to its maximum up position.

Rotation of the four-bar linkage extends or retracts a chain or toothed belt 118 which engages gear or sprocket 120. Opposing end 122 of chain 118 is then connected to an extension spring 124 which is wrapped around an idler pulley 126 and fixed at its opposing end 128 to frame 102. Spring 124 returns pedal 94 and its associated linkages to an up position. An identical four-bar linkage, chain, sprocket and spring return is provided for the opposing pedal 94 on the opposite side of system 10 so the pedals may operate independently of each other in a user-controlled stepping action.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims. The following claims are, therefore, to be read to include not only the combination of elements which are literally set forth, but all equivalent elements for performing substantially the same function in substantially the same way to obtain substantially the same result. The claims are thus to be understood to include what is specifically illustrated and described above, what is conceptionally equivalent, and also what essentially incorporates the essential idea of the invention.

We claim:

1. An improvement in a stepper having a pedal pivotally coupled to a four-bar linkage where said four linkage is coupled to a frame and said frame disposed on a supporting floor, said four-bar linkage comprising:

an upper arm pivotally coupled to said pedal at a first pivot point and to said frame at a second pivot point; and a pedal arm pivotally coupled to said pedal at a third pivot point spaced from said first pivot point and to said frame at a fourth pivot point spaced from said second pivot point;

wherein spacing between said first and third pivot points and between said second and fourth pivot points is arranged so that an imaginary line extending between said first and second pivot points of said upper arm are nonparallel to an imaginary line extending between said third and fourth pivot points, so that said pedal is oriented at least in one position of said four-bar linkage nonparallel to the floor.

2. The improvement of claim 1 wherein said pedal defines an angle of orientation with respect to said floor, and is capable of assuming an up position and a down position, and wherein said four-bar linkage varies said angle of orientation of said pedal as said pedal is moved between said down position and said up position.

3. A stepper comprising a four-bar linkage, said four bar linkage comprising a pedal and a frame, a first link extending between said pedal and said frame, said first link being connected to said pedal at a first pivot joint and being connected to said frame at a second pivot joint, a first reference line extending between said first pivot joint and said second pivot joint, a second link also extending between said pedal and said frame, said second link being connected to said pedal at a third pivot joint and being connected to said frame at a fourth pivot joint, a second reference line extending between said third pivot joint and said fourth pivot joint, said first reference line and said second reference line being non-parallel.

4. The stepper of claim 3, wherein said pedal comprises an upwardly extended flange and said first pivot joint is positioned on said flange.

5. The stepper of claim 4, wherein said first pivot joint is disposed generally above a step surface of said pedal.

6. The stepper of claim 3, wherein a spring is connected to said second link.

7. The stepper of claim 6, wherein a chain couples said spring to said second link.

8. The stepper of claim 6, wherein said spring is connected to an upper side of said second link such that same second link is urged upward.

9. The stepper of claim 3, wherein said second link is non-linear.

10. The stepper of claim 3, wherein said first link is generally below said second link.

11. The stepper of claim 3, wherein said first link and said second link are positioned on a single side of said pedal.

* * * * *